US007197254B2

(12) United States Patent
Tomita et al.

(10) Patent No.: US 7,197,254 B2
(45) Date of Patent: Mar. 27, 2007

(54) ADJUSTING METHOD FOR IMAGE-FORMING APPARATUS AND IMAGE-FORMING APPARATUS

(75) Inventors: Norio Tomita, Yamatokoriyama (JP); Mitsuharu Yoshimoto, Kitakatsuragi-gun (JP); Kyosuke Taka, Nara (JP); Nobuo Manabe, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 256 days.

(21) Appl. No.: 10/914,073

(22) Filed: Aug. 10, 2004

(65) Prior Publication Data

US 2005/0036799 A1 Feb. 17, 2005

(30) Foreign Application Priority Data

Aug. 11, 2003 (JP) ..... 2003-207169

(51) Int. Cl.
*G03G 15/00* (2006.01)

(52) U.S. Cl. ..... 399/49; 399/15; 399/72

(58) Field of Classification Search ..... 399/15, 399/301, 49, 38, 51, 72; 347/132, 116
See application file for complete search history.

(56) References Cited

U.S. PATENT DOCUMENTS 5,857,130 A * 1/1999 Ueda et al. ..... 399/17
2004/0240894 A1* 12/2004 Tomita et al. ..... 399/17

FOREIGN PATENT DOCUMENTS

| | | |
|---|---|---|
| JP | 7-125314 | 5/1995 |
| JP | 8-265560 A | 10/1996 |
| JP | 10-4493 A | 1/1998 |
| JP | 10-186994 | 7/1998 |
| JP | 2003-69789 A | 3/2003 |

* cited by examiner

*Primary Examiner*—David M. Gray
*Assistant Examiner*—Ryan D. Walsh
(74) *Attorney, Agent, or Firm*—Nixon & Vanderhye P.C.

(57) ABSTRACT

An image-forming unit 100 in a complex device A forms a correction-use image onto a sheet in accordance with data, in such a manner that the correction-use image thus formed partly on and partly off the sheet and includes edges of the sheet, the date being preliminarily determined in accordance with a size of the sheet. An image-detecting section 520 reads that portion of the correction-use image which is transferred on an image-transfer belt 7 as the correction-use image is formed by the image-forming unit 100. A correction value is calculated in accordance with data thus obtained by the image-detecting section 520. A control section then causes a data storing section to store the correction value. The control section reads out the correction value when forming an image in the complex device A, and forms the image, performing correction of the image, using the correction value for correcting an image-forming condition regarding how the image is formed on the sheet. The image-forming condition, such as a position and a copy-scale, can be adjusted, even if using an unadjusted reading apparatus.

22 Claims, 7 Drawing Sheets

ADJUSTING METHOD FOR IMAGE-FORMING APPARATUS AND IMAGE-FORMING APPARATUS

This Nonprovisional application claims priority under 35 U. S. C. § 119(a) on Patent Application No. 2003/207169 filed in Japan on Aug. 11, 2003, the entire contents of which are hereby incorporated by reference.

FIELD OF THE INVENTION

The present invention relates to an adjusting method for an image-forming apparatus and an image-forming apparatus. More specifically, the present invention relates to an adjusting method of adjusting an image-forming condition regarding how an image is formed on a sheet, such as a position of an image with respect to a sheet, and copy-scale (scale) of the image, in an electrophotographic image-forming apparatus or the like. The present invention further relates to the image-forming apparatus in which the adjustment is carried out by using the adjusting method.

BACKGROUND OF THE INVENTION

Conventionally, in an electrophotographic image-forming apparatus such as a copying machine, a printer, and a facsimile, an image is formed on a sheet, in accordance with image data supplied from a peripheral device.

In such image-forming apparatus, a positional error (mispositioning, shifting) of a image-forming position of an image with respect to the sheet is attributed to a misalignment between (a) a position (feeding position) to which the sheet is fed from a feeding means that is for feeding the sheet; and (b) a position of the image formed on an image-holding body (photosensitive drum) in accordance with the image data. This mispositioning is corrected by adjusting the feeding position of the sheet to its predetermined position, and adjusting the image-forming position to its predetermined position. The mispositioning is also corrected by adjusting one of (a) the position of the image formed on the image-holding body and (b) the feeding position of the sheet being fed, so as to match with each other. In addition to the positional error of the image-forming position, a copy-scale error sometimes takes place in forming the image.

In any of countermeasures described above, however, an amount and a status of the positional error on the sheet is first checked by visual check or by using an image-reading apparatus, in order to correctly evaluate the positional error that is taking place. The image-forming apparatus is then adjusted according to the evaluation result. This adjustment is carried out (a) when the image-forming apparatus is manufactured, (b) when the image-forming apparatus is installed by a service person, or (c) by the service person or a person in charge of assembling and adjusting, when exchanging a part or a unit relevant to the image forming.

Japanese Unexamined Patent Application, publication No. 125314/1995 (Tokukaihei 7-125314; published on May 16, 1995), discloses an arrangement in which an image-forming position on the sheet is adjusted by (a) outputting reference image data, which is preliminarily recorded in an image-forming apparatus, and (b) reading, by using an image-reading apparatus, the image thus outputted.

Further, Japanese Unexamined Patent Application, publication No. 186994/1998 (Tokukaihei 10-186994; published on Jul. 14, 1998) discloses an arrangement in which adjustment of an image-forming position on the sheet is carried out by (i) forming an unadjusted image, and then (ii) reading an unadjusted image by using an image reading means.

Further, Japanese Unexamined Patent Application, publication No. 271275/1988 (Tokukaisho 63-271275; published on Nov. 9, 1988) discloses a method of detecting a pattern formed on a feeding belt.

However, in the conventional arrangement described above, the adjustment requires a correctly-preadjusted reading apparatus, which has no positional error of reading position as a result of the correct preadjustment.

Namely, as disclosed in Tokukaihei 7-125314 and Tokukaihei 10-186994, reading of a chart of the image (to be used as a reference) by using an image-reading apparatus, which is a peripheral device, requires the correctly-preadjusted reading apparatus which has no positional error of reading position. Further the correctly-preadjusted image-reading apparatus which has no positional error of reading position is also necessary, when using the reading apparatus to read an image formed by outputting the reference image data, which is preliminarily recorded in the image-forming apparatus.

BRIEF SUMMARY

An adjusting method for an image-forming apparatus correctly adjust an image-forming condition regarding how an image is formed on a sheet, such as position of an image in relation to the sheet, copy-scale of the image, and the like, in the image-forming apparatus, even if a reading means (image-reading apparatus) for reading a formed image is not correctly adjusted. An image-forming apparatus is provided in which adjustment is carried out by the adjusting method.

An adjusting method of an image-forming apparatus is arranged such that the adjusting method includes the step of adjusting by using a correction value to correct an image-forming condition regarding how the image is formed on a sheet. The adjusting method includes the step of: forming a correction-use image on the sheet, the correction-use image being partly on and partly off the sheet and including at least three corner portions of the sheet, the correction-use image being formed from data predetermined in accordance to a size of the sheet.

In general, the sheet used in the image-forming apparatus is the sheet whose size is ready-made size, the ready-made size in which dimensions of the length and width are preliminarily determined.

In the step of forming the image in the adjusting method, the correction-use image, in accordance with the size of the sheet, is formed on the sheet, the correction-use image being partly on and partly off the sheet. Such formation of the image is performed, for example, by developing an electrostatic latent picture being formed on a photosensitive drum. In this way, correction-use image protruding beyond edges (boundary, corners, sides) of the sheet is formed.

Thus, for example, if using an unadjusted image-reading apparatus to read the correction-use image formed on the sheet in the step of forming the correction-use image, an error (positional error, scaling error) in image-forming conditions can be detected, by comparing the predetermined size of the sheet, and the size of the sheet that is read by the image-reading apparatus. Here, the size of the sheet can be surely read by the image-reading apparatus, because the correction-use image formed on the sheet is partly on and partly off the (protrudes beyond a boundary of the sheet) and includes at least three corners of the sheet. Note that the image-forming condition includes a position and a scaling of an image. This is because, in general, the image can accurately be formed by correcting the positional error and the scaling error; however the image-forming conditions are not limited to such conditions, and may include another condition.

By using the correction value, a correction value for accurately correcting the image-forming condition are obtained by comparing (a) a size of a region on which the correction-use image is supposed to be formed in accordance with a predetermined data, and (b) a size of that region on the sheet, on which the correction-use image is formed, and which is read by the image-reading apparatus. Using the correction value, the image formation is appropriately carried out. Note that when the adjustment is carried out with the correction value the image-forming condition is adjusted by, for example, a writing position, a writing timing with respect to the photosensitive drum, feeding timing of the sheet, and/or the like condition.

Therefore, even if using the unadjusted image-reading apparatus, the step of forming the correction-use image in the adjusting method makes it possible to accurately find out the correction value for correcting the image-forming condition regarding how the image is formed on the sheet.

Note that the data preliminarily determined in accordance with the size of the sheet may be a plurality of sets of data preliminarily determined respectively for sizes of the sheet, or one set of data preliminarily determined for the size of the sheet.

An image-forming apparatus in which a correction value for correcting an image-forming condition regarding how an image is formed on a sheet are calculated, is so arranged as to include: an image-forming section for forming an image on the sheet, using the correction value, and for forming a correction-use image on the sheet in accordance with data preliminarily determined in accordance with a size of the sheet, in order to obtain the correction value, the correction-use image being partly on and partly off the sheet and including at least three corner portions of the sheet; an image-transfer section for transferring the image onto the sheet, and for transferring the correction-use image onto the sheet, the correction-use image and the correction-use image thus formed by the image-forming section; an image-reading section for reading a remaining image of the correction-use image in the image-transfer section, the remaining image left on the image-transfer section after a sheet-corresponding portion of the correction-use image is removed by the image-transferring; and a correcting section for calculating the correction value for use in correcting the image-forming condition in accordance with data obtained by the reading of the remaining image by the image-reading section, the image-forming condition regarding how the image is formed on the sheet by the image-forming section.

Namely, in order to achieve the foregoing , the image-forming apparatus includes: (a) a image-forming section for forming an image on the sheet; and (b) a correcting section for obtaining the correction value for use in correcting the image-forming condition of the image-forming section with respect to the sheet. The image-forming section forming the image, uses the correction value obtained by the correcting section, wherein in order to obtain the correction value, the image-forming section forms a correction-use image on the sheet in accordance with data preliminarily determined in accordance with a size of the sheet, the correction-use image being partly on and partly off the sheet, and including at least three corner portions of the sheet. The image-forming apparatus further includes: (c) an image-transferring section for transferring the image onto the sheet, the image thus formed by the image-forming section; and (d) an image-reading section for reading a remaining image left on the sheet after a sheet-corresponding portion of the sheet is removed by the image-transferring, wherein the correcting section obtain the correction value in accordance with the data obtained by the reading of the remaining data by the image-reading section.

This image-forming apparatus executes the foregoing adjusting method of the image-forming apparatus. Thus, the image-forming apparatus results in the same effects as the foregoing adjusting method.

Additional objects, features, and strengths of the present invention will be made clear by the description below. Further, the advantages of the present invention will be evident from the following explanation in reference to the drawings.

DESCRIPTION OF THE EMBODIMENTS

An image-forming apparatus can adjust image-forming conditions, such as a position of an image with respect to a sheet and copy-scale of the image, even if a reading apparatus is not correctly adjusted. Example Embodiments are described below with reference to FIGS. 1 to 8.

A complex device (the image-forming apparatus) A of this embodiment forms a multiple-color image or a monochrome image, in accordance to image data, on a predetermined sheet (recording paper).

Figure 1:
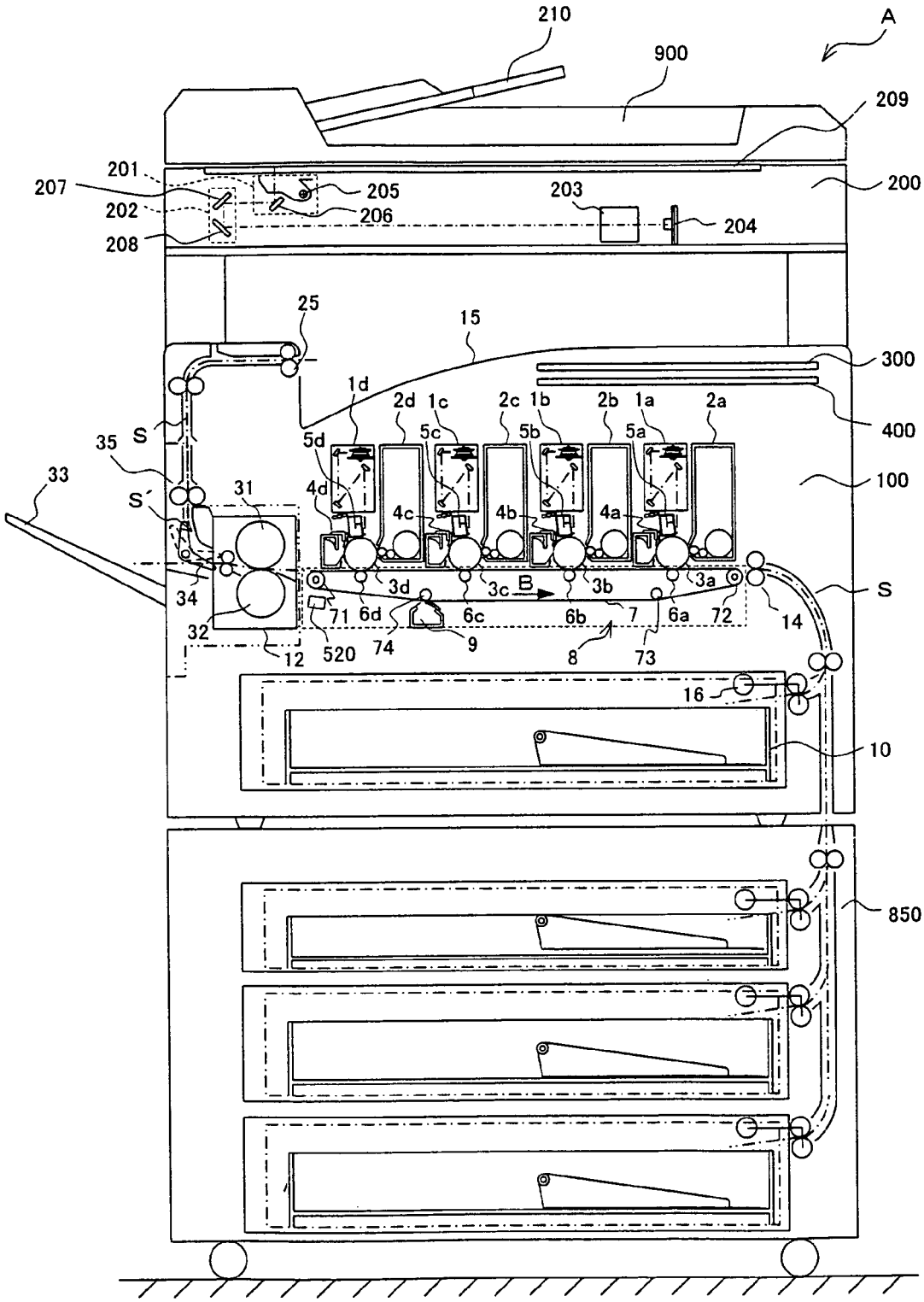
FIG. 1 is a cross sectional view showing a schematic configuration of an example embodiment of an image-forming apparatus.

Schematically speaking, the complex device A includes, an image-forming unit (image-forming section) 100, an image-reading unit 200, an automatic document feeder 900, and a desk-type sheet feeder 850, as shown in FIG. 1.

The image-forming unit 100 includes, exposing sections 1*a* to 1*d*, developing devices 2*a* to 2*d*, photosensitive drums 3*a* to 3*d*, cleaning sections 4*a* to 4*d*, electrifying devices 5*a* to 5*d*, an image-image-transfer feed belt unit (image-transfer section) 8, a fixing unit (fusing unit) 12, a feeding route S, a sheet-feeding tray 10, delivery trays 15 and 33, an image processing substrate 300, a controlling substrate 400, a pattern detector (image-reading section, image-detecting section) 520, and so on.

Note that image data that the complex device A handles is image data for a color image using black (K), Cyan (C) Magenta (M), and Yellow (Y). There are four image-forming stations, each of which forms respectively a latent picture of one of the four colors. Each image-forming station is respectively provided with the exposing section 1 (1*a*, 1*b*, 1*c*, or 1*d*), the developing device 2 (2*a*, 2*b*, 2*c*, or 2*d*), the photosensitive drum 3 (3*a*, 3*b*, 3*c*, or 3*d*), the cleaning section 4 (4*a*, 4*b*, 4*c*, or 4*d*), and the electrifying device 5 (5*a*, 5*b*, 5*c*, or 5*d*). Symbol "a" correspond with Black (K), symbol "b" with Cyan (C), symbol "C" with the Magenta (M), and symbol "d" with Yellow (Y).

As described, the image-forming stations include the exposing sections 1, the developing devices 2, the photosensitive drums 3, the cleaning sections 4, and the electrifying devices 5, respectively. The image-forming stations are located substantially in a center of the image-forming unit 100. The image-forming stations are aligned in order of KCMY along the image-transfer feed belt unit 8. Note that an alignment order is not limited to KCMY.

The exposing sections 1 in this embodiment are laser-reading units (LSUs), each of which has a laser-emitting section and a reflecting mirror. The exposing sections 1 are not limited to LSUs, and may be EL (Electro Luminescence) write heads, in which light-emitting elements are arrayed. The exposing sections may also be LED (Light Emitting Diode) write heads. By exposing charged photosensitive drums 3 to light in accordance with the image being input, the exposing sections 1 form electrostatic latent pictures on surfaces of the photosensitive drums, in accordance with the image data.

By using toners of the colors (K, C, M, Y) respectively, the developing devices 2 visualize electrostatic latent pictures formed on the respective photosensitive drums 3. The photosensitive drums 3 are for retaining the electrostatic latent pictures, which are formed in accordance with the exposure performed by the exposing section 1. The electrostatic latent pictures on the photosensitive drums 3 are developed into developer images (toner images) by the developing devices 2. The developer images are then transferred to the sheet. The cleaning sections 4 are for removing and collecting the residue of toner on surfaces of the photosensitive drums 3, after development and image transfer. The electrifying devices 5 are electrifying means for evenly charging (electrifying) the surfaces of the photosensitive drums 3 with a predetermined electric potential. A contact-type electrifying roller or a brush-type electrifying device may be used, instead of using the charger-type charging devices shown in FIG. 1.

The image-transfer feed belt unit 8 is located below the image-forming stations, which respectively have the photosensitive drums 3. The image-transfer feed belt unit 8 includes a image-transfer feed belt (image-transfer section) 7, a image-transfer feed belt driving roller 71, a image-transfer feed belt tension roller 72, a image-transfer feed belt driven roller 73, a image-transfer feed belt holding roller 74, transfer rollers 6 (6*a*, 6*b*, 6*c*, 6*d*), and an image-transfer feed belt cleaning section 9.

The image-transfer feed belt driving roller 71, the image-transfer feed belt tension roller 72, the image-transfer feed belt driven roller 73, the image-transfer feed belt holding roller 74, and the transfer rollers 6 are used for hanging an image-transfer feed belt (conveying belt) 7. The image-transfer feed belt driving roller 71 causes the image-transfer feed belt 7 to roll in a direction denoted by the arrow B. The image-transfer feed belt tension roller 72, the image-transfer feed belt driven roller 73, the image-transfer feed belt holding roller 74, and the transfer rollers 6 rotate in accordance with rotation of the image-transfer feed belt 7, which is rotationally moved by the image-transfer feed belt driving roller 71.

The transfer rollers 6 are for transferring the image onto the sheet by adsorption of the toner images of the photosensitive drums 3 toward the image-transfer feed belt 7. On one side of the image-transfer feed belt 7, the transfer rollers 6 are provided, whereas the photosensitive drums 3 on the other side thereof. Those transfer rollers 6 are rotationally supported by a frame (not shown) inside the image-transfer feed belt unit 8.

The image-transfer feed belt 7 is so arranged as to touch each of the photosensitive drums 3*a* to 3*d*. Further, the image-transfer feed belt 7 conveys the sheet by being rotationally moved by the image-transfer feed belt driving roller 71. As the sheet is conveyed as such, the toner images of the respective colors, formed on the photosensitive drums 3, are sequentially transferred to the sheet, so that the toner images overlap one another. Thereby, a color toner-image (multiple-color toner-image) is formed. This image-transfer feed belt 7 is a film having a thickness of 100 mm or the like thickness, being arranged in a ring-shape with no break point.

More specifically, a transfer of the toner images, from the photosensitive drums 3 to the image-transfer feed belt 7, is carried out by the transfer rollers 6 arranged on a back side of the image-transfer feed belt 7 with respect to the toner images. A high voltage is impressed to the transfer rollers 6 in order to transfer the toner images (for example, the high voltage has a charged polarity (+) opposite to a charged polarity (−) of the toner). Each transfer roller 6 of this embodiment is so arranged as to include a metal shaft (e.g. stainless) as its base member, the metal shaft having a diameter in a range of from 8 mm to 100 mm, and an elastic material on a surface of the metal shaft, the elastic material having conductivity, such as EPDM, foamed urethane, or the like. With such elastic material having conductivity, the transfer rollers 6 have an ability of changing their shape for being firmly attached to the photosensitive drums 3; thus, enabling an even impression of the high voltage to the sheet. Note that the transfer rollers 6 are used as transfer electrodes in this embodiment; however, the transfer electrodes are not limited to the transfer rollers 6, and the transfer electrodes may be brushes or the like.

Under the image-transfer feed belt unit 8, the pattern detector 520 is provided. The pattern detector 520 of this embodiment is a reading head, in which a line sensor and a lighting means are integrated. This pattern detector 520 is a line sensor having a reading means by which the image is monochromatically read.

Figure 5:
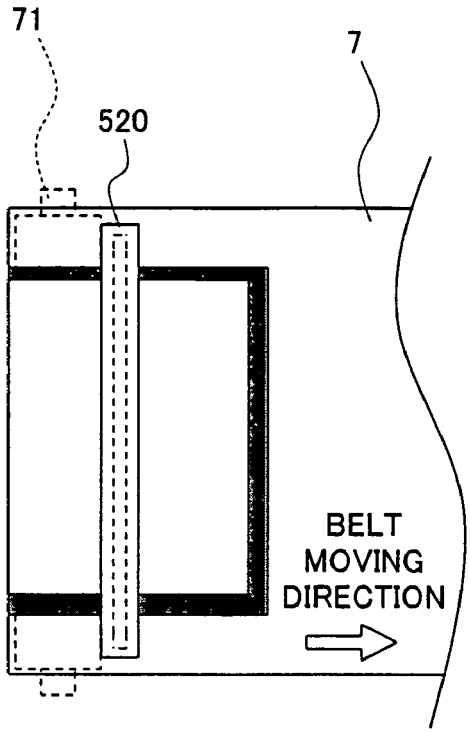
FIG. 5 is a plane view showing another part of the image-forming apparatus.

FIG. 5 is a plane view of the image-transfer feed belt 7 and the pattern detector 520 shown in FIG. 1, looking up from the bottom of FIG. 1. As shown in FIG. 5, the pattern detector 520, for use in detecting the image transferred to the image-transfer feed belt 7, is so arranged as to be extended in a main scanning direction, which is perpendicular to a moving direction of the image-transfer feed belt.

Figure 6:
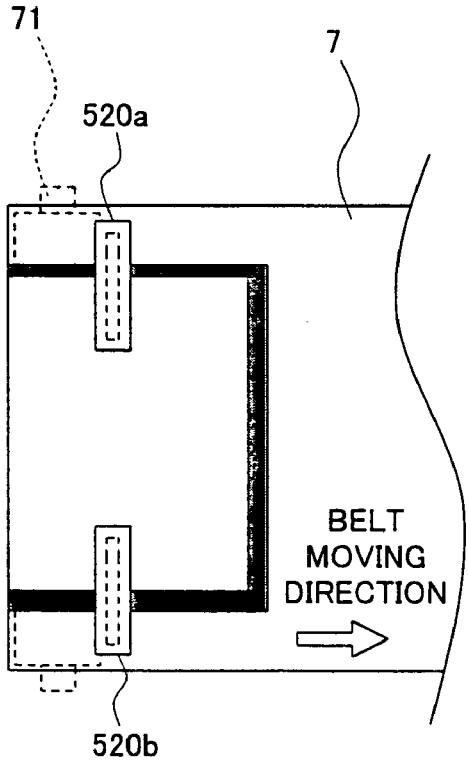
FIG. 6 is a plane view showing another example embodiment of correction-use image-forming apparatus.
Figure 7:
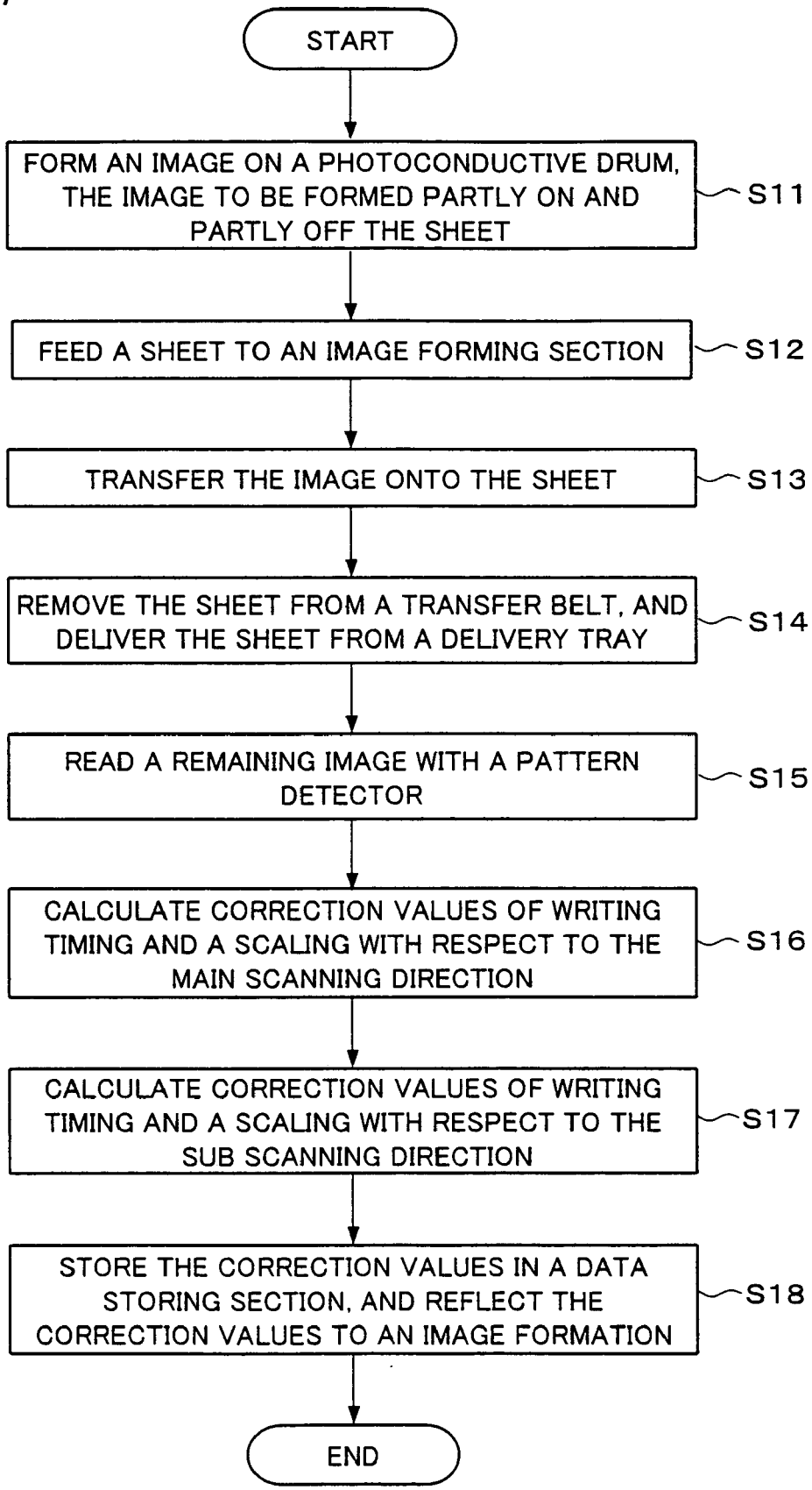
FIG. 7 is a flow chart showing an example of a process of adjusting image-forming conditions.

Note that the pattern detector is not limited to such arrangement and the arrangement may be like the pattern detector 520*a* in FIG. 6. Such arrangement shown in FIG. 6 is easily realized by, for example, adopting a commercially-available line image sensor head for use in a small size scanner. The line-image sensor head is commercially available with the resolution ranging from 200 to 300 dpi, a number of pixels from 864 to 1216, and a scan range of approximately 104 mm. Using the line-image sensor head, such arrangement in FIG. 6, having two pattern detectors, is easily realized. However, if the pattern detector also serves as a detector for detecting an image pattern that is used for correcting a color registration, it is necessary that the pattern detector have a limit of resolution not less than a resolution of image formation performed by the image-forming unit.

Note further that image-transfer feed belt cleaning roller 9 collects and removes the toner being adhered onto the image-transfer feed belt 7, in order to prevent the toner from staining on a back surface of the sheet, the toner being adhered to the image-transfer feed belt 7 as the image-transfer feed belt 7 touches the photosensitive drums 3. The image-transfer feed belt cleaning roller 9 is, for example, provided with a cleaning blade or the like. The cleaning blade or the like is so positioned to touch the image-transfer feed belt 7. The image-transfer feed belt 7 touching the cleaning blade is supported, from its back surface, by the image-transfer feed belt holding roller 74.

The sheet-feeding tray 10, for use in storing the sheet used in the image formation, is arranged below the image-transfer feed belt unit 8 of the image-forming unit 100. The delivery tray 15, provided above the image-forming unit 100, is for placing a printed sheet in a facing-down manner. The delivery tray 33, provided on a side of the image-forming unit 100, is for placing a printed sheet in a facing-up manner. Further, in the image-forming unit 100 there is provided the feeding route S, the feeding route in a shape of "S", for feeding the sheet from the sheet feeding tray 10 to the delivery tray 15, via the image-transfer feed belt unit 8, the fixing unit 12, and the like.

In a vicinity of the feeding route S, from the sheet-feeding tray 10 to the delivery tray 15 and the delivery tray 33, there are provided a pickup roller 16, a registration roller 14, a fixing unit 12, a feed direction switching gate 34, a feeding roller 25 for feeding the sheet, and the like.

The pickup roller 16, provided at an edge of the sheet-feeding tray 10, is a sheet-supplying roller for use in feeding the sheet one by one. The registration roller 14 is for temporarily holding the sheet fed through the feeding route S. Further, the registration roller 14 feeds the sheet timely in concert with the rotation of the photosensitive drums 3, whereby the toner images are successfully transferred from the photosensitive drums 3 to the sheet and form the image in which the toner images overlap one another. Namely, the registration roller 14 controls, in accordance with a data signal from a registration sensor (not shown), a registration clutch 515 shown in FIG. 2 so as to feed the sheet in a preset timing, in such a manner that a forefront of an image formation range of the sheet is matched with a forefront of each toner image on the photosensitive drums 3.

The fixing unit 12 is for fixing, onto the sheet, the toner images that has been transferred to the sheet. The fixing unit 12 includes a heating roller 31 and a pressurizing roller 32, and the like. The heating roller 31 and the pressurizing roller 32 rotate, sandwiching the sheet therebetween. The heating roller 31 and the pressurizing roller 32 are used for thermally compressing the sheet. For performing the thermal compression, the heating roller 31 is controlled by a control section described later, so as to generate a predetermined fixing heat, in accordance with a thermal detection value sent from a thermal detector (not shown). The thermal compression melts, mixes, and compresses the multiple-color toner image to the sheet, thereby thermally fixing the multiple-color image on the sheet.

Note that the sheet, after the multiple-color toner image is fixed, is conveyed to an inverting delivery route by the feeding rollers 25. In the inverting delivery route, the sheet is inverted (whereby the multiple-color toner image is faced downward). The inverted sheet is delivered to the delivery tray 15.

Further, the feed direction switching gate 34 is for switching over a delivery of the sheet, between to the delivery tray 33 and to the delivery tray 15. The feed direction switching gate 34 is rotatably positioned on a side cover 35. If the feed direction switching gate 34 shifts from a status shown by a solid line in FIG. 1 to the status shown by a broken line, the sheet is taken from the feeding route S on the way, so as to deliver the sheet to the delivery tray 33. If the feed direction switching gate 34 is in position shown by the solid line, the sheet is delivered to the delivery tray 15, through the feeding route S' (part of the feeding route S), the feeding route S' being from the fixing unit 12 to the side cover 35 through the feed direction switching gate 34. Along the feeding route S, there are provided a plurality of the feeding rollers 25, which are small size rollers for aiding and facilitating the conveying of the sheet.

The image processing substrate 300 is a circuit substrate for performing a predetermined process to the image data. The controlling substrate 400 is a circuit substrate for controlling an image formation process.

Above the image-forming unit 100, provided are the image-reading unit 200 and the automatic document feeder 900.

On a top surface of the image-reading unit 200, a document platen 209 is provided, the document platen made of a transparent glass. Above the document platen 209, the automatic document feeder 900 is provided.

The automatic document feeder 900 is an apparatus for automatically feeding, one by one, a plurality of the sheets (documents) to the document platen 209, the plurality of the sheets set on the document set tray 210.

The image-reading unit 200 of this embodiment is a color reading means. The image-reading unit 200 is used for reading the image on the sheet placed on the document platen 209. The image-reading unit 200 is provided with a first reading unit 201, a second reading unit 202, an optical lens 203, and a CCD (Charge Coupled Device) line sensor 204, which is a photo-electron converging means.

The first reading unit 201 includes an exposure lamp 205, a first mirror 206, and the like. The exposure lamp 205 is for use in exposing a surface of the sheet (document) to light. The first mirror 206 is for reflecting, to a predetermined direction, a reflected light beam (the image) from the document. The second reading unit 202 includes a second mirror 207 and a third mirror 208. The reflected light beam from the sheet (document) is reflected by the first mirror 206 of the first reading unit 201, thereby being sent to the second mirror 207 and the third mirror 208. Then, the reflected light is lead to the CCD line sensor 204 (which is a photo-electron converging element) by the second mirror 207 and the third mirror 208. The optical lens 203 causes the reflected light beam to form the image of the document (document image) on the CCD line sensor 204. The CCD line sensor 204 includes three image sensors respectively for a line of R (red), a line of G (green), and a line of B (blue). With this arrangement, the CCD line sensor 204 reads the image by reading the image in terms of three different colors.

Figure 8:
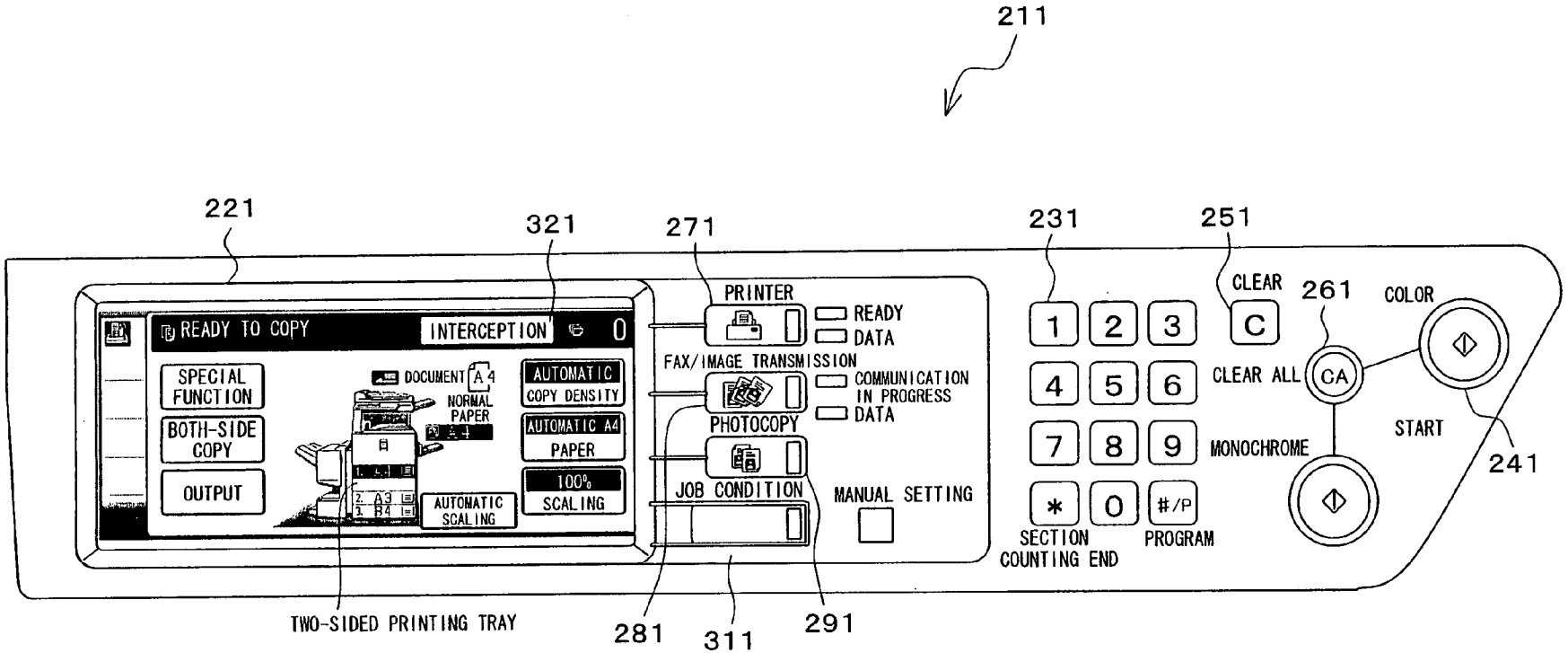
FIG. 8 is a plane view showing a control panel of the image-forming apparatus.

A control panel 211 shown in FIG. 8 is provided in a position, where the image-reading unit 200 of the complex device A is arranged. A touch-panel liquid crystal display device (hereinafter referred to as LCD) 221 is arranged on a left portion of the control panel 211; and on a right portion of the control panel 211, there are provided a ten-key keypad 231, a start key 241, a clear key 251, and a clear-all key 261.

A screen of the LCD 221 displays various screen pages, which can be switched over. These screen pages have touch-keys for setting various conditions, so that the various conditions (selecting monochrome mode or color mode, selecting a document type, selecting automatic or manual, and other special functions) can be selected by directly touching the touch-keys with a finger. Further the LCD 221 displays operation guidance, alarms and the like information. If the image-forming apparatus is provided with a select key for selecting whether or not to add an additional image (advertisement) or the like, the select key is arranged as a touch-key in the LCD 221, or as a hard-key on the control panel 221, as the ten-key keypad is. In such case, it is preferable that the select key be arranged as the touch-key on the LCD 221, so that the complex device A can have this function simply by installing software, thus allowing the same complex device A to be utilized commonly for the arrangements with and without this function.

Between the LCD 221 and the ten-key keypad 231, there are provided, for changing functions of the complex device A, a printer key 271, a facsimile/image transmission key 281, a copy key 291, and so on. There is further provided a job condition key 311 for checking job status of jobs being registered in each of the functions.

Of the keys arranged on the right portion of the LCD 221, the ten-key keypad 231 is for entering a numeric value (e. g. number of copies) into the screen of the LCD 221. The start key 241 is for instructing execution of an image forming action and a reading action in the processing modes. The clear key 251 is for clearing a setting value being displayed on the LCD 221, and for canceling an action (such as the image forming action) in process. The clear-all key 261 is for initializing reading conditions and the image-forming conditions or the like to a default value.

Note that the interruption key 321, displayed on the LCD 221, is for temporarily suspending the image forming action in process, and allowing to perform other image formation.

FIG. 8 shows a state in which a color-image formation mode is selected. In this state, density of the image formation and the image reading, such as copy density, is automatically controlled in accordance with how the document is.

The complex device A of this embodiment is so arranged that for adjusting the image-forming conditions, the complex device A is switched to a correction-value-obtaining mode (for obtaining a correction value) by pressing the ten-key keypad 231 and the other keys in a combination, which is specific in each type of devices.

Figure 2:
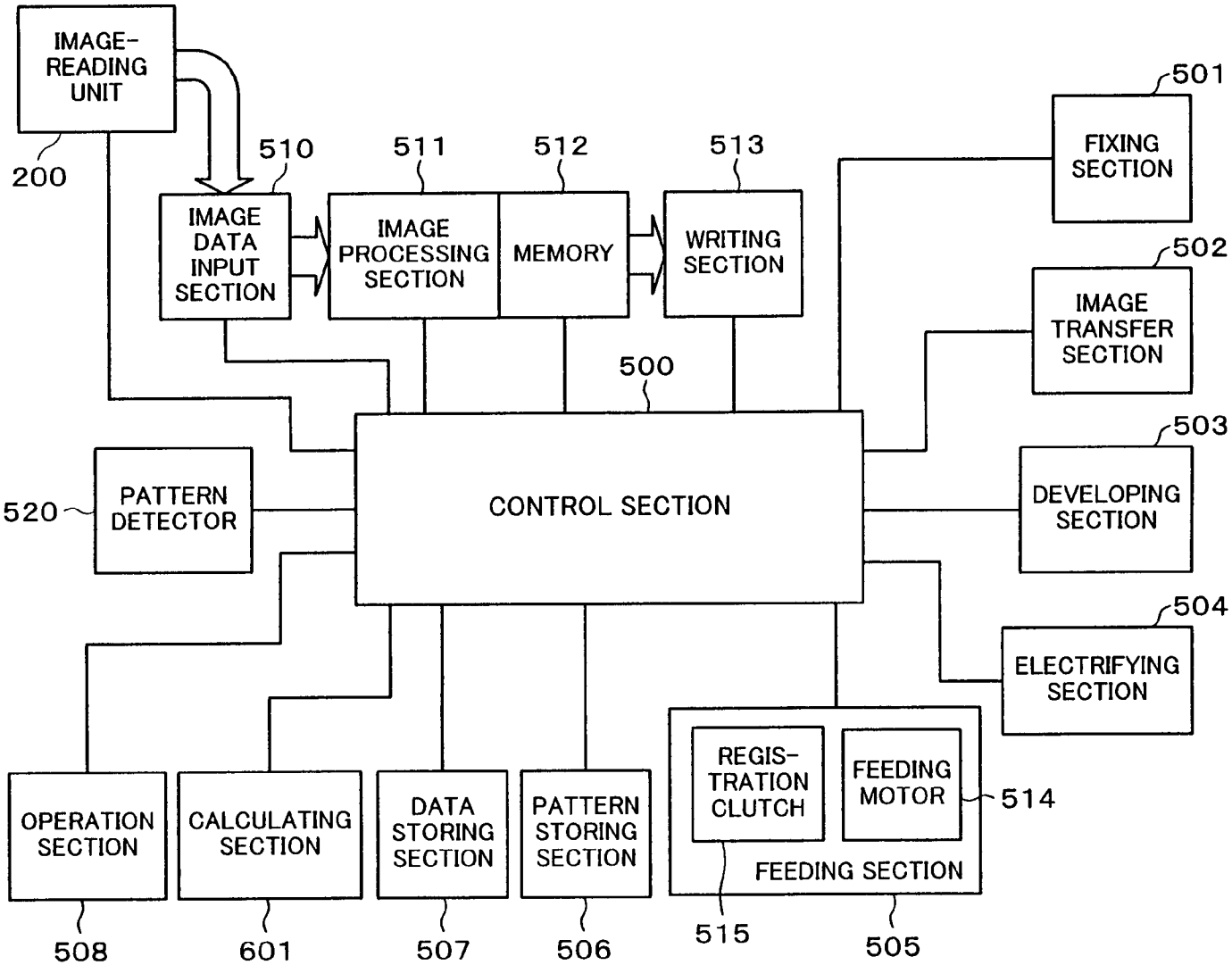
FIG. 2 is a block diagram illustrating the image-forming apparatus schematically.

Operating together with the automatic document feeder 900, by which the document is automatically fed, the image-reading unit 200 reads the image on the document thereby obtaining image data, and sends the image data to an image data input section 510 shown in FIG. 2.

For printing, by the image-forming unit 100, the document image read by the image-reading unit 200, the image data undergoes a predetermined image processing in an image processing section 511, and then temporarily stored in a memory 512. The image data in the memory 512 is then forwarded to a writing section 513, in response to an output command.

Further the complex device A is provided with the desk-type sheet feeder 850 under the image-forming unit 100. This desk-type sheet feeder 850 has three feeding trays, such that the sheets in the respective trays are distributed to the image-forming unit 100 via the feeding route S. Note that the desk-type sheet feeder 850 is not limited to such arrangement described in this embodiment. In accordance with a need of a user, the desk-type sheet feeder 850 may have only one feeding tray, or a tandem tray in which two trays are arranged in parallel. The desk-type sheet feeder 850 may also serve only as a desk.

Note further that in this embodiment the complex device A is provided with the automatic document feeder 900, in addition to the image-reading unit 200; however, the complex device A is not limited to such arrangement, and the complex device A may be. arranged without the automatic document feeder 900.

Further in this embodiment the complex device A can perform color printing; however, the complex device A is not limited to such arrangement, and the complex device A may be a device that can perform monochrome printing, but not the color printing. In such case, the complex device A generally has a monochrome image-reading apparatus, the image-reading apparatus having the image sensor for one line. It is needless to mention that such image-forming apparatus serving for monochrome image formation can have most of the functions of the present invention.

FIG. 2 is a block diagram schematically showing an arrangement of the complex device A, for describing control actions of the complex device A. The following deals with actions of the complex device A with reference to FIG. 2.

As shown in FIG. 2, the complex device A includes, the control section (image-forming unit, correcting section) 500. This control section 500, along with a pattern storing section (the image-forming unit) 506, a data storing section (the image-forming unit) 507, and a calculating section (correcting section) 601 correspond to the controlling substrate 400 in FIG. 1. Further, the image processing section 511 and the memory 512 in FIG. 2 correspond to the image processing substrate 300 in FIG. 1. Note that a structure of the control section 500 is not limited to this structure.

The control section 500 is connected with a fixing section 501, a transcription section 502, a developing section 503, an electrifying section 504, a feeding section (correcting section) 505, the pattern storing section 506, the data storing section 507, an operation section 508, the image data input section 510, the image processing section 511, the memory 512, and the writing section (the image-forming unit, correcting section) 513. The control section 500 controls each of those parts.

The fixing section 501 corresponds to the fixing unit 12 in FIG. 1, the transcription section 502 to the transfer rollers **6*a* to 6*d*, the developing section 503 to the developing devices 2*a* to 2*d*, the electrifying section 504 to the electrifying devices 5*a* to 5*d*, and the writing section 513 to the exposing section 1*a* to 1*d*. The operation section 508 corresponds to the control panel 211 in FIG. 8. Further, the feeding system section 505 includes a feeding motor 514 and the registration clutch 515**.

As described later, the pattern storing section 506 stores an image pattern that is to be used for adjusting the image-forming conditions of the complex device A. The image pattern is in accordance with a size of the sheet on which the pattern image is formed. The data storing section 507 stores a correction value being obtained by an operation described later. Further, the data storing section 507 stores a reference value of the sheet size in accordance to the image pattern stored in the pattern storing section 506.

The following describes how the control section 500 controls each of the sections being connected to the control section 500.

The control section 500 controls the heating roller 31 of the fixing section 501 (the fixing unit 12) to have a predetermined heat, in accordance with the thermal detection value from the thermal detector (not shown). The control section 500 controls the transcription section 502 so that the voltage from a image-transfer-use high voltage power supply (not shown) will be impressed to the transfer rollers **6*a* to 6*d*. The control section 500 controls the developing section 503 so that bias voltage of development rollers in the developing devices 2***a* to 2*d* will be so controlled that the development can be properly carried out. The control section 500 controls the electrifying section 504 so that a grid bias voltage of chargers (the electrifying devices 5*a* to 5*d*) is so controlled that surface potentials of the photosensitive drums 3*a* to 3*d* will be controlled. Further, the control section 500 controls the feeding system section 505 so that actions of the feeding motor 514 and the registration clutch 515 are controlled.

The control section 500 inputs and outputs predetermined image data of a pattern from/into the pattern storing section 506, controls the pattern storing section 506 to stores, for example, the pattern. The control section 500 controls the data storing section 507 so that the data storing section 507 performs inputting and outputting of the reference value, and stores, for example, the reference value.

The control section 500 causes the writing section 513 and the feeding system section 505 of the complex device A to operate in accordance with an image forming command or a reading command being entered to the operation section 508. The control section 500 causes the image data input section 510 to receive, at the image-forming unit 100, the image data read by the image-reading unit 200.

The control section 500 causes the image processing section 511 to conduct a predetermined image processing to the image data inputted to the image data input section 510. The control section 500 causes the memory 512 to temporarily store the image data being processed by the image processing section 511. The control section 500 controls the writing action of the writing section 513, in terms of power of a light beam, a writing timing, and the like conditions. Further, if the writing section 513 (exposure unit 1*a* to 1*d*) adopts EL or LED write head, the control section 500 controls the writing action of the write head, in terms of as power of a light beam and the writing timing, and the like conditions.

The control section 500 is also connected to the image-reading unit 200. By working in accordance with the automatic document feeder 900 shown in FIG. 1, the image-reading unit 200 reads the image on the document automatically fed by the automatic document feeder 900. The image being read is forwarded, as the image data, to the image data input section 510 shown in FIG. 2. The image data being sent to the image data input section 510, then undergoes the predetermined image processing in the image processing section 511. The image data, after the image processing, is temporarily stored in the memory 512. The control section 500 reads out the image data in the memory 512 and send the image data to the writing section 513, accordingly to the output command entered to the operation section 508.

Further in this embodiment, the control section 500 is connected to the pattern detector 520 and the calculating section 601. The pattern detector 520 is for reading a remaining image, which is transferred on the image-transfer feed belt 7. Using reading data obtained by reading the remaining image on the image-transfer feed belt 7 by using the pattern detector 520, the calculating section 601 calculates out the correction value for use in correcting the image-forming conditions with respect to the sheet.

The following explains how the correction value is obtained by using the pattern detector 520 and the calculating section 601. For easy understanding, it is not specified in the following description which one of the image-forming stations is subjected for calculation of the correction value.

It is assumed that a maximum usable sheet size that the complex device A can use is A3 size (297 mm×420 mm). In this case, not only A3 size, but also A4 size (210 mm·297 mm), B5 size (182 mm·257 mm), B4 size (257 mm·364 mm), etc may be used for calculating the correction value. Particularly, for calculating the correction value, it is preferable that the complex device A use the sheet whose size is smaller than the maximum usable sheet size. Because, if using the sheet whose size is larger than the maximum usable sheet size, the correction-use image formed on the sheet must be enlarged as much as the sheet size is larger than the maximum usable sheet size. This not only causes an increase in a consumption of the developer (toner), but also requires longer time for adjusting the complex device A. Further, a size of the entire apparatus also becomes large, because it is required that the processing means (such as the exposure unit, the photosensitive drums, the developing devices, etc.) have long lengths in the main scanning direction. In case where a sheet that of a size other than (but smaller than) the maximum usable size, However, the adjustment is more accurately carried out by using a larger size sheet; though the adjustment takes longer time, and consumes more developer (toner), because the correction-use image must be enlarged when being formed on the sheet. On the other hand, by using a smaller sheet, the correction-use image is formed in small size. This saves the developer (toner), and shortening the time consumed for the adjustment.

When the operation section 508 receives, from the user, a command for adjusting the image-forming conditions, the complex device A executes the image formation for the adjustment, by using the sheet in the sheet-feeding tray 10 or the like. At this point, the control section 500 reads out the image data stored in the pattern storing section 506. Then the control section 500 writes the image data in the memory 512. The writing section 513 forms the correction-use image from the image data in the memory 512. The correction-use image thus formed is located in an area (or each area) including at least three corner portions of the sheet.

In this embodiment, the pattern storing section 506 stores such an image that includes the edges of the sheet and is partly on and partly off the sheet. Namely, as indicated as the reference image (frame image (correction-use image)) by a shaded area in FIG. 3, the correction-use image is formed on the sheet protruding beyond the edges of the sheet (the edges of the sheet are hypothetically shown by dotted lines in FIG. 3). The area in which the correction-use image is formed, thus includes three corner portions (R1, R2, R3) of the sheet. Note that "the corner portions" means apexes of the sheet; that is, the areas including intersections at which two of the edges of the sheet intersect each other. The area, in which the correction-use image is formed, is not limited to such figuration shown in FIG. 3, as long as the intersections are included in the area. For example, the correction-use image does not have to be the frame image whose entire periphery is continuous, and the correction-use image may include at least the three corner portions (R1 to R3). With this arrangement, an amount of the developer (toner) used in the adjustment is saved.

The frame image in this embodiment is set as follows. The size in the main scanning direction is set, for example, 230 mm (W3). This size (W3) in the main scanning direction is wider than 210 mm, yet narrower than a maximum image formation width. An inside width (W4) of the main scanning direction is set, for example, 180 mm. This inside width (w4) is narrower than 210 mm; narrow enough for a case in which the sheet size of A4 is used. The size in a sub reading direction is set, for example, 317 mm (L3), so as to be longer than 297 mm. An inside length of the sub reading direction is set, for example, 267 mm. This inside length is shorter than 297 mm; short enough for the case in which the sheet size of A4 is used.

Note that it is not economical to use the frame image whose size is too large. A typical positional error in an apparatus that needs the adjustment, is preliminarily determined by an experiment or the like, so as to find out a possible positional error in feeding. Taking into account the possible positional error in feeding, the image data is created with sufficient allowance. The pattern storing section 506 stores the image data thus created. In this embodiment, the pattern storing section 506 stores a plurality of patterns (image data), which are respectively in accordance with various sheet sizes, so as to be able to deal with the various sheet sizes. The present invention, however, is not limited to this, and the pattern storing section may store a single frame image which can be used for the various sheet sizes.

Figure 3:
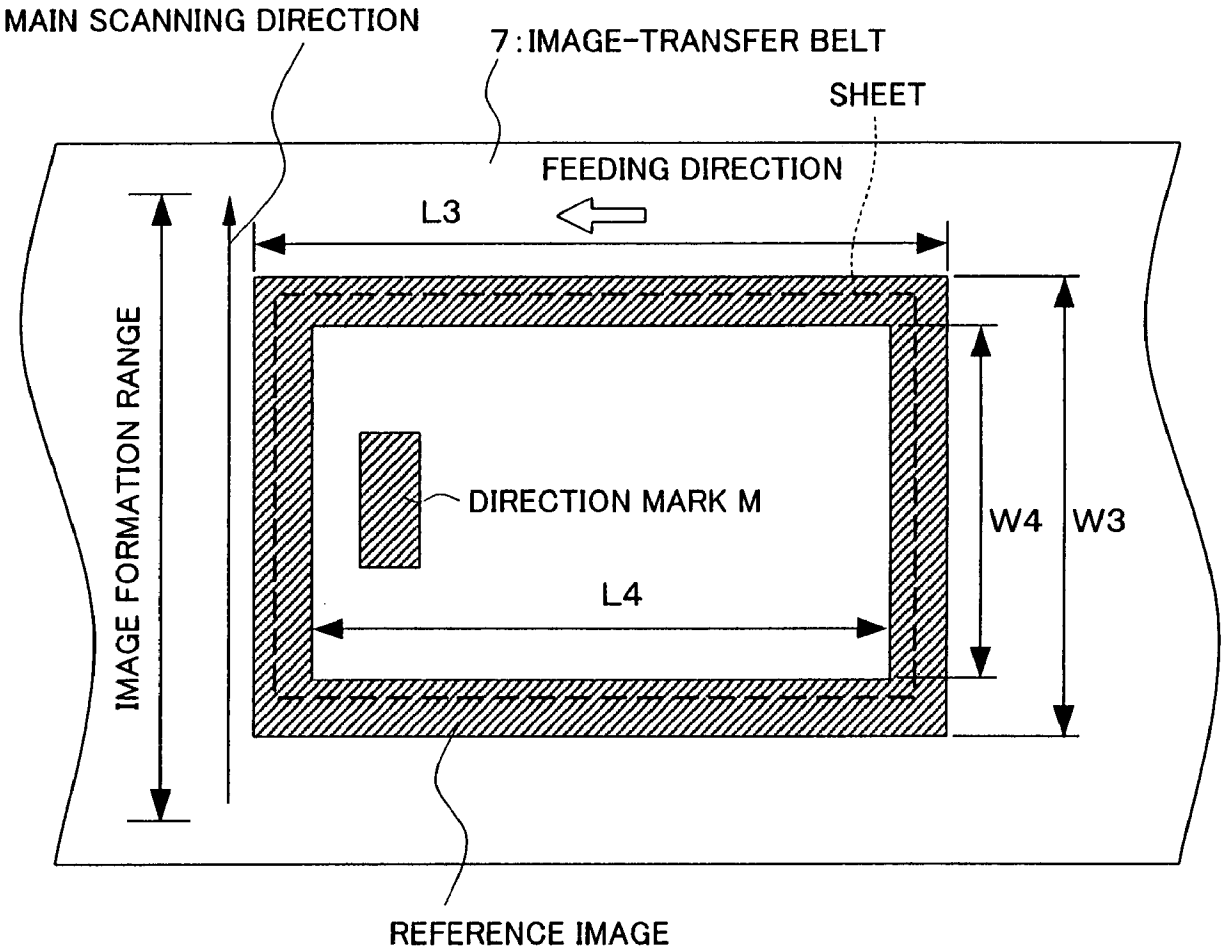
FIG. 3 is a plane view showing a part of the image-forming apparatus.

Here, the frame image is formed on the sheet on the image-transfer feed belt 7 (see FIG. 1), the frame image protruding beyond the boundary (being partly on and partly off the sheet). By transferring such correction-use image as shown in FIG. 3 onto the sheet, the image-transfer feed belt 7 has a remaining image as shown in FIG. 4, as a result of the image transfer, by which a portion (sheet-corresponding portion) of the correction-use image is transferred onto the sheet.

Here, assuming that a sheet of B5 size is used, an effective range for image formation is 257 mm if the effective range for image formation is set to be equal to the length of the sheet. Thus, regardless of whether the sheet is fed in a widthwise direction or in a lengthwise direction, the correction-use image being partly on and partly off the sheet can be formed on the sheet, so that the image-transfer feed belt 7 will have the remaining image. However, for example, in case where the sheet of A4 size is fed, the correction-use image being partly on and partly off the sheet cannot be formed if the sheet is so fed that the lengthwise direction of the sheet is perpendicular to the sub reading direction so that the effective range for image formation equals to the length of the sheet of A4. In such case of using the sheet of A4, the sheet should be fed in lengthwise direction, placing the sheet so that the lengthwise direction of the sheet is in parallel to the sub reading direction. When using the sheet of A4 size; WO in FIG. 4 is 210 mm, and LO in FIG. 4 is 297 mm.

Figure 4:
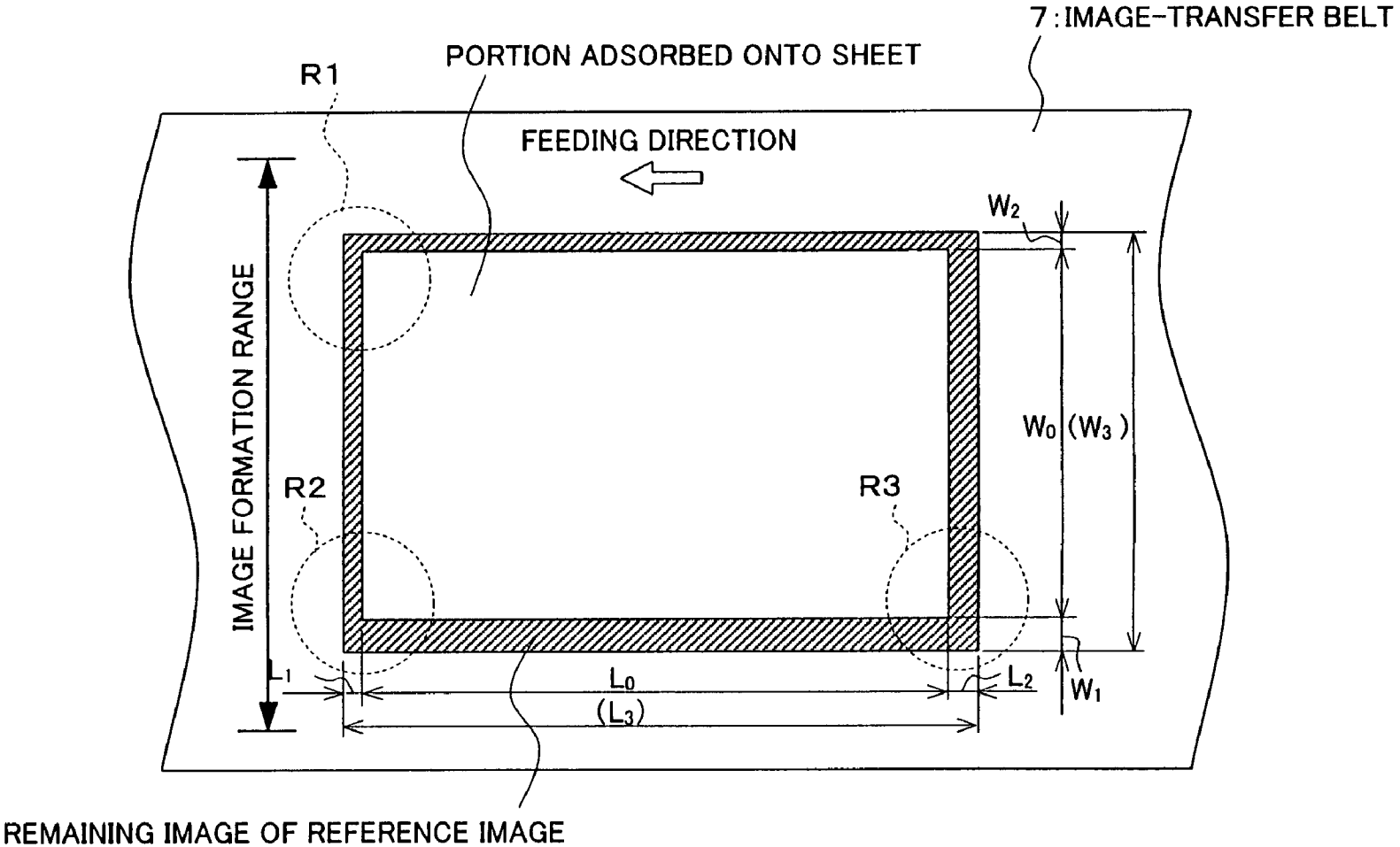
FIG. 4 is a plane view showing the part in another status different from the status shown in FIG. 3.

Then, as the image-transfer feed belt 7 rolls, the remaining image shown in FIG. 4 reaches to a position of the pattern detector 520 shown in FIG. 1.

The pattern detector 520 reads the image on the image-transfer feed belt 7 (see FIG. 5). In the following, described is the sub reading direction. L0 in FIG. 4, described above, can be found out by the pattern detector 520. Since L0 corresponds to the size of the sheet, a feeding speed of the image-transfer feed belt 7, which is a means for feeding the sheet, can be calculated from a time consumed for reading L0. A copy-scale with respect to the sub reading direction can be found out by comparing the sheet size, which is already known, and L0 obtained by reading; or comparing L3 of a preliminary setting, and L3 obtained by reading. The copy-scale with respect to the sub reading direction can also be found out from the time consumed in reading L3. Further, a correction value (positional error) of a writing start point in the sub reading direction of the writing means, can be found out from the time obtained by reading L1.

Next described is the main scanning direction. The scaling with respect to the main scanning direction can be calculated by reading W3 using the pattern detector 520. Further, a correction value (positional error) of a writing start point in the main scanning direction of the writing means, can be found out by reading W1 using the pattern detector 520.

In this embodiment, V1 and the V3 has a relation ship of V1=V3, and the scaling with respect to the sub reading direction will change if V2≠V1, where V1 is a speed of the image-transfer feed belt 7, V2 is a rotational speed (peripheral velocity) of the photosensitive drums 3, and V3 is the feeding speed of the sheet. As understood from this, the scaling with respect to the sub reading direction is so arranged that it may change depending on the speed of the image-transfer feed belt 7 or the speed of the photosensitive drum 3. Further the scaling with respect to the sub reading direction is so arranged that it may change, accordingly to a setting of the exposing section 1, the exposing section 1 of the LSU. As for the scaling with respect to the main scanning direction, it is only dependent on the exposing section 1, and not the speed.

In addition, to find out W3 in a case that the pattern detector 520*a* shown in FIG. 6 is used instead of the pattern detector 520 shown in FIG. 5, W1 and W2 are figured out with the respective pattern detectors (line image sensor head). Then, W3 can be calculated from W1+W2+W0, where W0 is the reference value of the sheet.

In this embodiment, the pattern detector 520 is used for measuring the image transferred on the image-transfer feed belt 7; however, the present invention is not limited to this arrangement. For an image-forming apparatus without the image-transfer feed belt, such as an image-forming apparatus using a discharging type transferring charger, the present invention may be so adopted as to measure a remaining image on the photosensitive drum, which is left on the photosensitive drum after a sheet-corresponding portion of the correction-use image is removed by the image-transfer.

Further this embodiment deals with the complex device A (the image-forming apparatus) in which the image formation is carried out by electrostatically adhering the toner onto the sheet on the image-transfer feed belt 7; however, the present invention is not limited to such image-forming apparatus. The present invention may be implemented to an intermediate belt transfer system in which respective images of the respective colors are transferred to an intermediate image-transfer feed belt in such a manner that the images overlap each other, and the overlapped images are transferred en bloc on the sheet being fed. In such case, the same effect is obtained by measuring a remaining image on the intermediate image-transfer feed belt, which is left the intermediate image-transfer feed belt after a sheet-corresponding portion of the correction-use image is removed by the image-transferring.

Using the correction value (positional error) thus obtained, the positional error is corrected as described below.

The adjustment with respect to the main scanning direction is carried out as follows. The image-forming unit 100 of this embodiment has the exposing section 1, which is an LSU. Therefore, the adjustment with respect to the main scanning direction is carried out as follows: in the laser beam scanning method, the writing start point is adjusted by adjusting a timing from a time at which the sheet passes a beam detector to a time at which the writing is started. Further, the scaling with respect to the main scanning direction is controlled by adjusting a timing of lighting per pixel.

Note that, in a case of solid-body reading system having the LED write head or the like as the exposing section 1, the writing start point with respect to the main scanning direction is adjusted by determining which light-emitting element to start lighting (that is, by shifting that point on the main scanning direction, from which the lighting starts). In the case of LED head or the like, it is not necessary to adjust the scaling of the main scanning direction, since the scaling of the main scanning direction is substantially determined; however, if the positional error becomes too obvious, the number of the light-emitting elements to be lighted is increased or decreased by not using part of the image data or adding supplemental data to the image data.

Next described is the adjustment with respect to the sub reading direction. The position with respect to the sub reading direction is adjusted by adjusting at least one of (a) connecting timing of the registration clutch 515 and (b) the writing-start timing for the exposing section 1 to start forming the image on the photosensitive drums 3. Further, the scaling of the sub reading direction is adjusted by adjusting at least one of (a) the rotational speed of the photosensitive drums 3 and (b) the feeding speed of the sheet (the rolling speed of the image-transfer feed belt 7). In this embodiment, the feeding speed of the sheet; i. e. , the speed of the feeding motor 514 of the feeding system section 505, is adjusted, because the adjustment of the feeding speed of the sheet does not change conditions of an image formation process. Note that the correction value for correction is calculated in the calculating section 601, by using L0 and L3 obtained in the way described above.

For ease of understanding, the above description does not particularly specify the image-forming station to be corrected. In this embodiment, it is possible to find out the correction value of image-forming positions with respect to one of the image-forming stations, from the correction value with respect to another one of image-forming stations.

Here, in the complex device A of this embodiment which forms a multiple-color image, the correction value of the color registration can be calculated by, for example, detecting, with the pattern detector 520, the positional error of a thin-line pattern formed in each of the image-forming stations, with respect to the thin-line pattern formed in the image-forming station being set as a reference.

The correction value of the color registration includes the correction values with respect to two directions; i.e., the correction value with respect to the sub reading direction, and the correction value with respect to the main scanning direction. Limiting resolution of such correction value of the color registration is normally higher than the resolution of the image-forming unit. As such, the position is adjustable in the resolution higher than a single line (single pixel). In the image-forming unit 100 arranged in the complex device A of this embodiment, the resolution with respect to the sub reading direction and the resolution with respect to the main scanning direction are both 600 dpi. Accordingly, the pattern detector 520 of this embodiment has a higher resolution than that of the image-forming unit 100.

Note that the resolution of approximately 0.1 mm to 0.3 mm is sufficient for calculating the correction value for correcting the positional error as described above, for calculating the correction value for correcting the scaling error, and for image-forming conditions (the image-forming position on the sheet). Therefore, in a case of separately providing the pattern detector and the detector used for calculating the correction value of the color registration, there may be adapted, for example, the small-size line image sensor head (which is commercially available) as the pattern detector 520*a* of the resolution ranging from 300 dpi to 85 dpi. Further the line image sensor head can also be adapted in a case of a monochrome image-forming apparatus, in which the correction value of the color registration is not needed.

The following describes the actions described above with the reference to a flow chart in FIG. 7.

In step S11, firstly, the control section 500 writes, into the memory 512, the pattern image being stored in the pattern storing section 506, when the operation section 500 receives an adjustment command from the user. Then the writing section 513 forms the frame image on the photosensitive drum 3 as the electrostatic latent picture. The electrostatic latent picture on the photosensitive drum 3 is then developed by the developing device 2.

In step S12, the sheet is fed from the sheet-feeding tray 10 to the image-forming unit 100 through the feeding route S.

In step S13, the developer image is transferred onto the sheet and the image-transfer feed belt (conveying belt) 7 by conveying the sheet by using the image-transfer feed belt 7.

In step S14, the image-transfer feed belt 7 further feeds the sheet to the fixing unit 12. Hereby, only the remaining image is left on the image-transfer feed belt 7. The sheet is then delivered from the delivery tray 15 or 33.

In step S15, the remaining image on the image-transfer feed belt 7 is read by the pattern detector 520, as the image-transfer feed belt 7 further rolls.

In step S16, the calculating section 601 extracts, from the image data being obtained, the width W0 through W4 as shown in FIG. 4. The calculating section 601 then calculates the correction value of the scaling with respect to the main scanning direction, and for the writing timing with respect to the main scanning direction.

In step S17, the calculating section 601 extracts, from the image data being obtained, the length L0 through L4 shown in FIG. 4. The calculating section 601 then calculates the correction value of the scaling with respect to the sub reading direction, and for the writing timing with respect to the sub reading direction.

In step S18, the correction value obtained are stored in the data storing section 507.

The correction value of adjusting the image-forming conditions is thus obtained by the actions described above. The control section 500 reads out the correction value being stored in the data storing section 507, in order to perform the adjustment in the image formation, by using the correction value.

Note that this embodiment deals with the case in which the complex device A is the image-forming apparatus having a plurality of the image-forming stations for formation of the image using a plurality of color materials, wherein the image-forming apparatus corrects the color registration in accordance with color registration correction data being obtained with the pattern detector 520 or a detector (not shown) specialized for use in the color registration. In such case, the color registration correction data is also stored in the data storing section 507.

With this arrangement, such image-forming apparatus can calculate the correction value of correcting the image-forming conditions using one of the colors for forming the correction-use image. The correction value with respect to other colors is calculated using the color registration correction data. With such image-formation apparatus, the image-forming conditions with respect to the sheet can economically be adjusted, because only one of the colors is used.

Further, in a case where the pattern detector 520 is the color image reading means as in the present embodiment, it is preferable that the image on the sheet be read by using one of three photo-electron converging means, each of the three photo-electron converging means respectively associated with one of three colors. In this way, it will be read to scan, and the volume of the image data to be obtained will become less, thus shortening time taken for processing the image data.

Note that the present invention is not limited to such arrangement, and a plurality of the image-forming stations may be adjusted differently. More specifically, for example, it may be so arranged as to adjust the positions and the scaling with respect to the main scanning direction and the sub reading direction in one of the image-forming stations, and respectively adjust the positions and the copy-scale with respect to the main scanning direction in the rest of the image-forming stations. In this way, the image-forming conditions with respect to the sheet can be more accurately adjusted.

Further, regarding the positional error of the image formation on the sheet, if the image-forming apparatus has a plurality of the sheet-feeding means (sheet-feeding trays), the sheet-feeding trays are individually adjusted as to the positional error. Then, the correction values are calculated for the respective sheet-feeding trays, and the correction values for the respective sheet-feeding trays are stored in the data storing section 507. Note that the scaling error is calculated when calculating the correction value with respect to one of the sheet-feeding trays, and it is not necessary to calculate the scaling error with respect to all of the sheet-feeding trays.

As described, this embodiment deals with the complex device A in which the correction-use image is formed on the sheet including the sheet edges, for adjusting the image-forming conditions such as the positional error of the image formation and the scaling error. Further, the complex device A calculates the correction value from the positional error and the scaling error being calculated in accordance with the data being obtained by reading the remaining image on the image-transfer feed belt by using the pattern detector 520, the remaining image being that portion of the correction-use image which is left on the sheet after a sheet-corresponding portion of the correction-use image is removed by the image transfer (image-transferring).

With such arrangement, it is possible to adjust the complex device A, even if the pattern detector 520 is not accurately adjusted.

Note that this embodiment deals with cases in which the present invention is adapted to (a) the color-image-forming apparatus that can form the color-image, and (b) a color-image-reading apparatus that can read the color-image; however, it is needless to mention that the same effect is acquired by the present invention by using (i) the monochrome image-forming apparatus that can only form the monochrome (Black and White ) image, and (ii) the monochrome image-reading apparatus that can only read the monochrome image.

The image-reading apparatus being correctly adjusted is required for the adjustment conventionally. In addition, to detect the positional error, it is necessary, for example, to detect the edges of the sheet for detecting the position of a predetermined mark being formed on the sheet. However, it is difficult to detect such predetermined mark, because the sheet, which is usually white, is scanned with a white background. For that reason, the positional error has been visually checked by a service person.

In view of such problems, the present invention is so arranged that the correction-use image is formed on the sheet partly on and partly off the sheet and including the edges of the sheet, so that the sheet size can be detected, and an unadjusted reading apparatus can be used. Further, the position of the sheet is easily detected from the positions of the edges.

It should be noted that an object of the Japanese Unexamined Patent Application, publication No. 271275/1988 (Tokukaisho 63-271275) mentioned above is to correct the color registration. Although various patterns formed on a feed belt are detected in the patent application, the present application differs from the patent application in the objects of the measurement.

The present invention is not limited to the embodiment above, but may be altered within the scope of the claims. An embodiment based on a proper combination of technical means is encompassed in the technical scope of the present invention.

As described, an adjusting method of an image-forming apparatus in accordance with the present invention is an adjusting method of an image-forming apparatus, the adjusting method comprising the step of adjusting by using a correction value to correct an image-forming condition regarding how the image is formed on a sheet, the adjusting method comprising the step of: forming a correction-use image on the sheet, the correction-use image being partly on and partly off the sheet and including at least three corner portions of the sheet, the correction-use image being formed from data predetermined in accordance to a size of the sheet.

Therefore, by performing the step of forming the correction-use image in the adjusting method, it is possible to accurately find out the correction value, despite of using an unadjusted image-reading apparatus after the step of forming the correction-use image, the correction value being for use in correcting the image-forming condition regarding how the image is formed onto the sheet.

In addition of the aforementioned arrangement, the adjusting method of the present invention includes the step of reading a remaining image, which is that portion of the correction-use image, which is not removed by sheet and left on the image-transfer section after image-transfer to the sheet.

For example, by, as in the step of reading, reading by the image-detecting section, the remaining image left on the image-transfer section, after a sheet-corresponding portion of the correction-use image is removed by the image-transferring, it is possible to accurately find out the correction value (i) for correcting a positional error (shifting) in reading performed by the image-detecting section, and (ii) for correcting the image-forming condition regarding how the image is formed on sheet.

For example, as the sub reading direction, by measuring the feeding speed of the sheet-feeding means, it is possible to judge whether or not the image-forming position and the scaling with respect to the sub reading direction are appropriate. Further, it is possible to obtain the correction value of a timing of image formation with respect to the sub reading direction. As for the main scanning direction, it is possible to detect the positional disagreement between the sheet and the image along the main scanning direction. Thus, it is possible to obtain the correction value for correcting the writing timing and the scaling, with respect to the main scanning direction.

Note that the foregoing adjusting method of the image-forming apparatus may also be expressed as an adjusting method of the image-forming apparatus, the method including the step of reading an edge of the remaining image left on the transfer section of the image-forming section.

With such arrangement thus described, it becomes possible to, by reading the remaining image, find out the correction value accurately, the correction value being for use in correcting the image-forming condition regarding how the image is formed on the sheet.

Further, in addition to the aforementioned arrangement, the adjusting method of the present invention includes the step of calculating, in accordance to the size of the sheet, the correction value from data of the remaining image obtained in the step of reading.

In the step of calculating the correction value, the correction value is obtained in accordance with the size of the sheet. Thus, with the step of calculating the correction value, it becomes unnecessary to use a reference document or the like specially used for adjustment, the reference document or the like having a reference size. That is, it is possible to obtain a correction value, not only for the sheet of the ready-made size in which the lengthwise and the widthwise dimensions are fixed, but also for sheets having other sizes.

Further, the step of the adjusting method is also advantageous in that it is possible to detect separately (a) the positional error caused by the image-forming section and (b) the positional error caused by the sheet-feeding system.

Note that the foregoing adjusting method of the image-forming apparatus may also expressed as an adjusting method of an image-forming apparatus, having step S of (a) forming a correction-use image in accordance with predetermined data, the correction-use image including at least three corner portions of the sheet; and (b) reading a remaining image by using an image-detecting means provided in the image-forming section, the remaining image being not transferred onto the sheet, wherein the image-forming apparatus is adjusted by using the correction value for correcting the image-forming condition regarding how the image is formed onto the sheet, the correction value being obtained in accordance with image data thus obtained by reading the remaining image.

With such arrangement, it becomes unnecessary to use a reference document or the like specially used for adjustment, the reference document or the like having a reference size.

Further, in addition to the aforementioned arrangement, the adjusting method of the present invention is so arranged that, in the step of forming the correction-use image, the correction-use image is so formed on the sheet that the correction-use image includes all edges of the sheet and protrudes beyond the boundary (is partly on and partly off the sheet).

As such, the correction value of a reading error and for the image-forming conditions are accurately and easily obtained by, for example, reading a positional relationships between the sheet and the correction-use image thus formed thereon, in terms of frontward, backward, rightward, and leftward direction. Namely, the reading and the calculation thereafter can be easily performed, because the correction-use image includes all of the edges.

Further, with this arrangement, the correction value of the reading error and the correction value of the image-forming conditions can be accurately and easily calculated, even in a case where, for example, the image-detecting section of the image-forming section reads the correction-use image (portion of the correction-use image) not transferred onto the sheet after the image-transfer by which the portion of the correction-use image within the edges of the sheet is transferred onto the sheet.

Further, in addition to the aforementioned arrangement, the adjusting method of the present invention is so arranged that, in the step of forming the correction-use image, the sheet is so conveyed that a lengthwise direction of the sheet is in parallel to a sub reading direction of the image-forming apparatus, the image-forming apparatus for use in forming the image on the sheet.

With such image forming process, the correction-use image can be formed on the sheet protruding beyond the boundary including the edges of the sheet (boundary, corners, sides), without fail.

The image formation is usually carried out with a margin left in a circumference of the sheet. In some types of the image-forming apparatus, however, a writing range of the writing means in the image-forming apparatus (the writing range with respect to the main scanning direction) is set so as to be extremely close to the limit of the size with respect to the main scanning direction of the image-forming apparatus. In such image-forming apparatus, if feeding the sheet so that the lengthwise direction of the sheet is in parallel to the main scanning direction of the image-forming apparatus, there is a possibility that the correction-use image fails to include the edges of the sheet.

By arranging such that the sheet is set in the image forming process so that the lengthwise direction of the sheet is set in parallel to the sub reading direction of the image-forming apparatus, not only the correction-use image can be formed on the sheet, the correction-use image including the edges of the sheet without fail, but also the reading error can be prevented. This further prevents an increase in costs, because it is not necessary to expand the writing range of the image-forming apparatus.

For example, in case of the image-forming apparatus in which the image is formed on the sheet of A3 size at the maximum, calculation of the correction value by using the sheet of A4 size is so performed that the sheet of A4 size is fed in such a manner that the lengthwise direction of the sheet is in parallel to the sub reading direction of the image-forming apparatus.

Note that the foregoing adjusting method may be expressed as an adjusting method of an image-forming apparatus in which a sheet is fed in such a manner that a dimension of the sheet along a direction perpendicular to a feeding direction is narrower than a maximum image formation range.

As described, an image-forming apparatus according to the present invention, having an image-forming section for forming an image on a sheet, and a correcting section for finding out (obtaining) a correcting value for use in correcting an image-forming condition regarding how the image is formed on the sheet by the image forming section, the image-forming section forming the image, using the correction value obtained by the correcting section, wherein in order to obtain the correction value, the image forming section forms, on the sheet, a correction-use image being partly on and partly off the sheet and including three corner portions of the sheet, the image-forming apparatus further comprising an image-transfer section for transferring the image onto the sheet, the image thus formed by the image-forming section, and an image-reading section for reading a remaining image on the image-transfer section, the remaining image being that portion of the correction-use image which is not removed by sheet and left on the image-transfer section after image-transfer to the sheet, and the correcting section obtains the correction value in accordance with data obtained by the reading of the remaining image by the image-reading section Such image-forming apparatus, in which the foregoing adjusting method is carried out, gives the same advantages as that of the adjusting method.

Note that the image-forming apparatus may have an image-forming section in which a plurality of the image-forming stations are arranged (tandem structure). Further, the image-forming apparatus may be so arranged that the image-forming section performs multi-color image formation by rotating a photosensitive drum a number of times that correspond to a number of developer materials having different colors (by rotating 4 times in case where the number of the developer material is 4 (4 rotation arrangement).

Further, the color registration correction value can usually be set respectively for each of the image-forming stations in the structure having the plurality of the image-forming stations. Therefore, by obtaining the correction value for one of the image-forming stations, it becomes possible to perform, for all the image-forming stations, the correction of the image-forming position with respect to the sheet. However, in such case, the scaling need be performed per the image-forming station.

Note that the image-forming apparatus, in which the adjustment is carried out according to one of the foregoing methods, may be the image-forming apparatus including: (a) a writing means for forming an image on an image holding body; (b) a feeding means for feeding a sheet; (c) an image-transferring means for transferring the image on the sheet that is fed; (d) an image-detecting means for reading that portion of the image which is not transferred to the sheet; and (e) a calculating means for calculating a correction value for use in correcting an image-forming condition regarding how the image is formed on the sheet, wherein the correction value is obtained from a correction-use image formed by the writing means in accordance with image data preliminarily determined, the correction-use image including at least three corner portions of the sheet, and the image-forming apparatus includes (f) a controlling means for controlling, in accordance with the correction value, operation of the writing means and/or the feeding means.

Further, in addition to the aforementioned arrangement, the image-forming apparatus in accordance with the present invention is so arranged that the image-forming section is capable of forming the image by using a plurality of color materials; and the image-forming unit forms the correction-use image for correction of an image-forming position on the sheet, by using at least one of the color materials.

In such image formation in which, as in the above arrangement, the correction-use image is formed by using at least one of the color materials, it is possible to easily obtain correction values for all the rest of the color materials by obtaining only the correction value for the formation position of the image with respect to the sheet, and by referring to the registration correction data (color registration correction data).

Namely, in the multiple-color image-forming apparatus, there are usually provided the color registration correction data, with which the image-forming positions of the colors are corrected by referring to one of the colors that is set as the reference. Because of this, the correction values for other colors can simply be obtained in accordance with the color registration correction data, by obtaining the correction value by using the correction-use image using the one of the color materials, the correction value being for correcting the image-forming position on the sheet.

Therefore, the correction value for use in correcting the image-forming position of the sheet, do not have to be calculated for all of the colors by forming the correction-use images of the respective colors. Only required is to form a correction-use image of any one of the colors. Therefore, it is possible to perform the adjustment economically. Moreover, it is possible to reduce time necessary for reading the data and calculating the correction value.

As described, the adjustment is economically carried out in such arrangement, because, only one of the color materials is used in the image formation, the image formation for calculating the correction value for correcting the image-forming position of the sheet; and the correction values for the other colors can simply be calculated in accordance with the color registration correction data.

Note that the foregoing arrangement can also be adapted to the tandem structure or four-rotation structure. Further, the foregoing image-forming apparatus may also be expressed as an image-forming apparatus in which an image is able to be formed using a plurality of color materials; and an adjustment is carried out by forming a correction-use image by using at least one of the color materials.

Further, in addition to the aforementioned arrangement, the image-forming apparatus of the present invention is so arranged that: the image-forming section has a plurality of image-forming stations, the image-forming stations respectively using different color materials; in order to find out, by using the correcting section, the correction value with respect to one of the plurality of the image-forming stations, the correction-use image is formed by using one of the plurality of the image-forming stations, in accordance with the data being preliminarily determined in accordance to the size of the sheet, the correction-use image being partly on and partly off the sheet and including at least three corner portions of the sheet; and in accordance with the correction value and color registration (correction) data for correcting color registrations of the respective image-forming stations, the correcting section finds out a correction value for correcting the image-forming position, with respect to the image-forming stations.

When adapting the arrangement to so-called a tandem type image-forming apparatus in which the image of each of the colors (which form the multiple-color image) is formed separately in the image-forming stations, the adjustment can economically carried out in because the correction values for all of the image-forming stations can be calculated by the image formation in one of the image-forming stations, Namely, in the typical tandem type image-forming apparatus, the image-forming position is corrected in each of the image-forming stations, and the image is formed in accordance with the color registration correction data, thereby avoiding color disagreements.

Therefore, if the image-forming condition (positional error) with respect to the sheet is obtained for one of the image-forming stations as described, the image-forming conditions (image-forming position) for all images of the colors can be set in accordance with the color registration correction data. Thus, it is not necessary to set the image-forming conditions for the respective image-forming stations.

Note that the foregoing image-forming apparatus may also be expressed as an image-forming apparatus having a plurality of image-forming stations, in which only one of the image-forming stations is adjusted to calculate correction value, by using one of the foregoing adjusting methods of the image-forming apparatus; image-forming conditions of all the image-forming stations are corrected in accordance with the correction value and color registration correction data, when forming an image.

Further, in addition to the aforementioned arrangement, the image-forming apparatus according to the present invention is so arranged that the image-reading section is an image-detecting section for detecting a disagreement (color disagreement) between (i) an image of reference color, which is for use in calculating color registration correction data, and (ii) a color image being subjected to an adjustment.

With such arrangement in which the image-reading section has the function of the image-reading section and that of the image-detecting section, it becomes unnecessary to separately provide the image-reading section and the image-detecting section; thus, it is possible to provide an image-forming apparatus in which cost performance is improved.

Further, the image-detecting section has a limit of resolution higher than a level of resolution necessary for the image formation, the image-detecting section being for detecting a disagreement (color disagreement) between (i) an image of reference color, which is for use in calculating color registration correction data, and (ii) a color image being subjected to an adjustment. Therefore, with this arrangement, it is possible to surely obtain, by using the image-detecting section having such a high resolution, the correction value for the image-forming condition regarding how the image is formed on the sheet.

Note that the foregoing image-forming apparatus may also be expressed as an image-forming apparatus having an image-detecting section for use in (a) detecting an image disagreement (color disagreement) between an image of a color (the image to be subjected to the adjustment), and the image of a reference color for use in calculating the color registration (correction) data; and (b) calculating the correction value described above.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An adjusting method of an image-forming apparatus, the adjusting method comprising the step of adjusting by using a correction value to correct an image-forming condition regarding how the image is formed on a sheet, the adjusting method comprising the step of:

forming a correction-use image on the sheet, the correction-use image being partly on and partly off the sheet and including at least three corner portions of the sheet, the correction-use image being formed from data predetermined in accordance with a size of the sheet.

2. The adjusting method of the image-forming apparatus as set forth in claim 1, further comprising the step of:

reading a remaining image, which is that portion of the correction-use image which is not removed by the sheet and which is left on the image-transfer section after image-transfer to the sheet.

3. The adjusting method of the image-forming apparatus as set forth in claim 2, comprising the step of:

calculating, in accordance with the size of the sheet, the correction value from data of the remaining image obtained in the step of reading.

4. The adjusting method of the image-forming apparatus as set forth in claim 1 wherein:

in the step of forming the correction-use image, the correction-use image is formed on the sheet whereby the correction-use image includes all edges of the sheet and protrudes beyond a boundary of the sheet.

5. The adjusting method of the image-forming apparatus as set forth in claim 1, wherein:

in the step of forming the correction-use image, the sheet is conveyed so that a lengthwise direction of the sheet is in parallel to a sub reading direction of the image-forming apparatus, the image-forming apparatus for use in forming the correction-use image on the sheet.

6. The adjusting method of the image-forming apparatus as set forth in claim 1 wherein:

the sheet is fed in such a manner that a dimension of the sheet along a direction perpendicular to a feeding direction is narrower than a maximum image formation range.

7. The adjusting method of the image-forming apparatus as set forth in claim 3 wherein:

in the step of calculating the correction value, the sheet is smaller than a maximum usable sheet size for the image-forming apparatus.

8. The adjusting method of the image-forming apparatus as set forth in claim 3 wherein:

in the step of calculating the correction value, a position of the sheet with respect to a main scanning direction is adjusted by adjusting a writing starting position by adjusting a timing from a time at which the sheet passes a beam detector to a time at which the writing is started.

9. The adjusting method of the image-forming apparatus as set forth in claim 3 wherein:

in the step of calculating the correction value, a scaling with respect to a main scanning direction is adjusted by adjusting lighting timing per pixel, an exposing section performing exposure at the lighting timing per pixel, in order to form an electrostatic latent picture in accordance with an image data.

10. The adjusting method of the image-forming apparatus as set forth in claim 3 wherein:

in the step of calculating the correction value, a position of the sheet with respect to a sub reading direction is adjusted by adjusting one of (i) an image formation starting timing and (ii) a connecting timing of a registration clutch.

11. The adjusting method of the image-forming apparatus as set forth in claim 3 wherein:

in the step of calculating the correction value, a scaling with respect to a sub reading direction is adjusted by adjusting at least one of (i) rotational speed of photosensitive drums and (ii) speed of feeding the sheet.

12. An image-forming apparatus in which a correction value for correcting an image-forming condition regarding how an image is formed on a sheet is calculated, the image-forming apparatus comprising:

an image-forming section for forming an image on the sheet by using the correction value, and for forming a correction-use image on the sheet in accordance with data preliminarily determined in accordance with a size of the sheet, in order to obtain the correction value, the correction-use image being partly on and partly off the sheet and including at least three corner portions of the sheet;

an image-transfer section for transferring the image onto the sheet, and for transferring the correction-use image onto the sheet, the image and the correction-use image thus formed by the image-forming section;

an image-reading section for reading a remaining image of the correction-use image in the image-transfer section, the remaining image left on the image-transfer section after a sheet-corresponding portion of the correction-use image is removed by the image-transferring; and a correcting section for calculating the correction value for use in correcting the image-forming condition in accordance with data obtained by the reading of the remaining image by the image-reading section, the image-forming condition regarding how the image is formed on the sheet by the image-forming section.

13. The image-forming apparatus as set forth in claim 12, wherein:

the image-forming section is capable of forming the image by using a plurality of color materials; and the image-forming unit forms the correction-use image for correction of an image-forming position on the sheet, by using at least one of the color materials.

14. The image-forming apparatus as set forth in claim 13, wherein:

the image-forming section has a plurality of image-forming stations the image-forming stations respectively using different color materials;

in order to find out, by using the correcting section, the correction value with respect to one of the plurality of the image-forming stations, the correction-use image is formed by using one of the plurality of the image-forming stations, in accordance with the data being preliminarily determined in accordance with the size of the sheet, the correction-use image being partly on and partly off the sheet and including at least three corner portions of the sheet; and in accordance with the correction value and color registration (correction) data for correcting color registrations of the respective image-forming stations, the correcting section finds out a correction value for correcting the image-forming position, with respect to the image-forming stations.

15. The image-forming apparatus as set forth in claim 12 wherein:

the image-reading section is an image-detecting section for detecting a disagreement between (i) an image of reference color, which is for use in calculating color registration correction data, and (ii) a color image being subjected to an adjustment.

16. The image-forming apparatus as set forth in claim 12, wherein:

the image-forming section performs multi-color image formation by rotating a photosensitive drum a number of times that correspond to a number of developer materials having different colors.

17. The image-forming apparatus as set forth in claim 12 wherein:

the sheet is fed in the image-forming unit in such a manner that a dimension of the sheet along a direction perpendicular to a feeding direction is wider than a maximum image formation range.

18. The image-forming apparatus as set forth in claim 12, wherein:

the sheet used by the correcting section is smaller than a maximum usable sheet size for the image-forming apparatus.

19. The image-forming apparatus as set forth in claim 12, wherein:

the correcting section adjusts a position of the sheet with respect to a main scanning direction by adjusting a writing starting position by adjusting a timing from a time at which the sheet passes a beam detector to a time at which the writing is started.

20. The image-forming apparatus as set forth in claim 12, wherein:

the correcting section adjusts a scaling with respect to a main scanning direction by adjusting that lighting timing per pixel, an exposing section performing exposure at the lighting timing per pixel, in order to form an electrostatic latent picture in accordance with an image data.

21. The image-forming apparatus as set forth in claim 12 wherein:

the correcting section adjusts a position of the sheet with respect to a sub reading direction by adjusting one of (i) an image formation starting timing and (ii) a connecting timing of a registration clutch.

22. The image-forming apparatus as set forth in claim 12, wherein:

the correcting section adjusts scaling with respect to a sub reading direction by adjusting at least one of (i) rotational speed of photosensitive drums and (ii) speed of feeding the sheet.

* * * * *